US005205910A

United States Patent [19]

Arbizzani et al.

[11] Patent Number: 5,205,910

[45] Date of Patent: Apr. 27, 1993

[54] DISTILLATION CHAMBER FOR EXTRACTING DRY-CLEANING SOLVENT FROM SLUDGE

[75] Inventors: Tommaso Arbizzani; Gualtiero Ghelardini, both of Pontecchio Marconi, Italy

[73] Assignee: Sodibo S.p.A., Bologna, Italy

[21] Appl. No.: 752,120

[22] Filed: Aug. 29, 1991

[30] Foreign Application Priority Data

Sep. 19, 1990 [IT] Italy ..... 3658 A/90

[51] Int. Cl.[5] ..... B01D 3/02

[52] U.S. Cl. ..... 202/175; 202/170; 202/176; 202/204; 202/252; 68/18 R; 68/18 C; 134/109; 159/25.1; 203/100; 203/DIG. 25

[58] Field of Search ..... 202/175, 168, 169, 170, 202/234, 252; 203/DIG. 16, 100, DIG. 25; 159/16.1, 13.1, 13.4, 25.1, 29, 43.1, 901, DIG. 26; 68/18 R, 18 C; 134/12, 109

[56] References Cited

U.S. PATENT DOCUMENTS

| | | | |
|---|---|---|---|
| 1,970,732 | 8/1934 | Bonath | 159/25.1 |
| 3,169,537 | 2/1965 | Fuhring | 202/170 |
| 3,177,126 | 4/1965 | Charreau | 202/170 |
| 3,672,958 | 6/1972 | McCandlish | 202/170 |
| 3,801,274 | 4/1974 | Gleason | 68/18 C |
| 3,997,406 | 12/1976 | Arvanitakas | 202/175 |
| 4,038,184 | 7/1977 | Svanteson | 159/25.1 |
| 4,279,704 | 7/1981 | Noble . | |
| 4,313,786 | 2/1982 | Smith | 159/DIG. 26 |
| 4,372,818 | 2/1983 | Kaganovsy et al. | 202/175 |
| 4,885,099 | 12/1989 | Kelly . | |
| 4,909,898 | 3/1990 | Padliya et al. | 202/175 |
| 5,047,123 | 9/1991 | Arvanitakis | 202/175 |

FOREIGN PATENT DOCUMENTS

| | | |
|---|---|---|
| 0309415 | 3/1989 | European Pat. Off. . |
| 2584617 | 1/1987 | France . |

*Primary Examiner*—Wilbur Bascomb, Jr.
*Attorney, Agent, or Firm*—Guido Modiano; Albert Josif

[57] ABSTRACT

Distillation chamber for extracting solvent from sludge, in particular for dry-cleaning machines, having a bottom shaped like a half-cylinder with a horizontal axis. The bottom is provided, in a downward position, at one end, with an outlet for extracting dried sludge. A shaft is axially and rotatably mounted in the chamber and spatula-like sectors, suitable for stirring the sludge and for pushing it toward the outlet upon the rotation of the shaft, are fixed to the shaft itself.

4 Claims, 1 Drawing Sheet

1
2
3
4
5
6
7
8
9
10
11
12
13
14
15
16
17
18
19
A
B

DISTILLATION CHAMBER FOR EXTRACTING DRY-CLEANING SOLVENT FROM SLUDGE

BACKGROUND OF THE INVENTION

The present invention relates to a distillation chamber for extracting solvent from sludge, in particular for dry-cleaning machines.

It is known that significant amounts of perchloroethylene are absorbed by the filtration powders during the working cycle of dry-cleaning machines.

The sludge to be treated also contains other residues of the washing operation, and the solvent content is such as to subject their storage and disposal to stringent statutory provisions and make them sometimes not only expensive but impossible.

In order to recover the perchloroethylene from the powders, it is known to subject said powders to distillation, but the efficiency of conventional systems leaves solvent residues in the powders in amounts in the range of even more than 10%.

it is also known that since at a temperature lower than 120° C. the solvent does not evaporate and at temperatures above 150° C. the solvent degrades, the sludge must be dried at a temperature comprised between said two values.

Furthermore, by heating the sludge to extract the perchloroethylene, sometimes the extraction temperature is reached in some regions and not in others, and a certain thickness of solid mud also stratifies on the bottom; it has been shown that it is necessary to stir the mud before and during distillation in order to operate optimally.

Furthermore, when it is necessary to remove the powders and the remaining mud at the end of extraction, the operator intervenes directly, opening the distillation chamber onto the environment and subjecting himself and said environment to pollution.

The interest in acting so as to reduce the perchloroethylene content to a level which allows the user of the washing apparatus to contract firms specialized in distillation waste treatment and which avoids contamination of the operators and of the environment, is evident.

SUMMARY OF THE INVENTION

The technical aim of the present invention is indeed to solve the above described problems, i.e. to provide a distillation chamber which allows the evaporation of the perchloroethylene from the sludge without reacting, in any point, temperatures close to the solvent degradation temperature and with no danger of pollution of any kind.

Within the scope of this technical aim, an object of the present invention is to achieve said aim with a simple structure which is relatively easy to execute in practice, safe in use and effective in operation as well as relatively modest in cost.

This aim and this object are all achieved by the present distillation chamber for extracting solvent from sludge, in particular for dry-cleaning machines, characterized in that it comprises a semi-cylindrical bottom with a horizontal axis which is provided, in a downward position, at one end, with an outlet for extracting dried sludge, said chamber being provided with an axially mounted and rotatably actuated shaft, spatula-like means being fixed to said shaft and being suitable, upon the rotation of said shaft, for stirring the sludge and pushing it toward said outlet.

BRIEF DESCRIPTION OF THE DRAWINGS

Other features and advantages of the distillation chamber according to the present invention will become apparent and evident from the detailed description of a preferred but not exclusive embodiment thereof, illustrated only by way of non-limitative example in the accompanying drawings, wherein.

DESCRIPTION OF THE PREFERRED EMBODIMENTS

Figures 1, 2, 3:
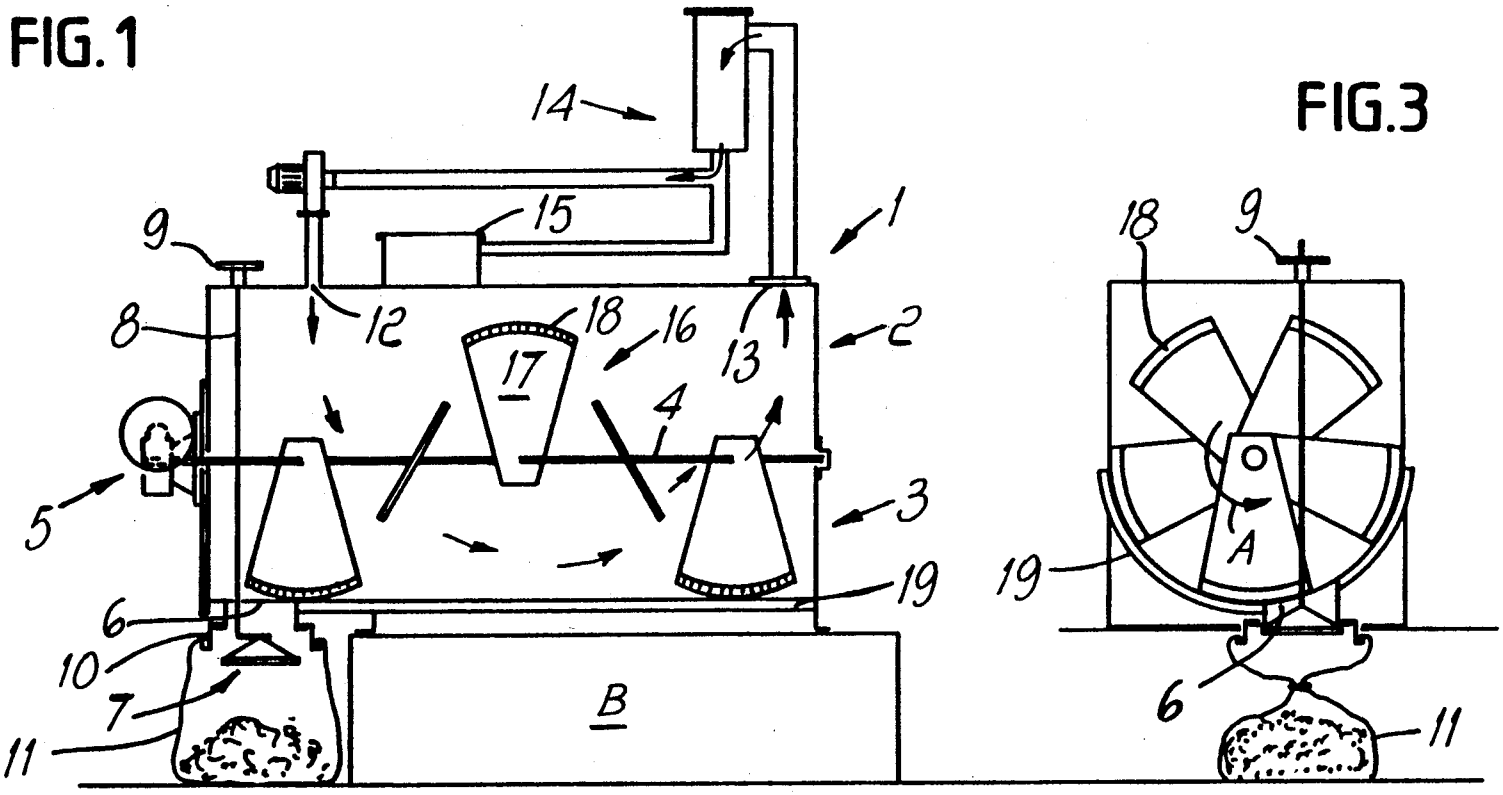
FIG. 1 is a lateral sectional view, taken along a diametrical plane, of a distillation chamber according to the invention.
FIG. 2 is a plan view of the paths of the spatula-like means in the low vertical position.
FIG. 3 is a sectional front view, taken along a vertical plane, of the distillation chamber.

With particular reference to the above figures, the reference numeral 1 generally indicates the distillation chamber according to the invention.

The chamber 1 has a parallelepipedal shape at an upper portion 2 thereof 2, has a semi-cylindrical shape with an elongated horizontal axis at a lower portion 3 thereof, and is fixed to a base B. The numeral 19 indicates means for heating the sludge in the chamber so as to evaporate the solvent; said means being constituted by a heating chamber of the steam or diathermic-oil type. A horizontal shaft 4 is mounted axially and rotatably with respect to the chamber and is rotationally actuated in the direction of the arrow A by a motor-reduction unit assembly 5.

Said chamber 1 has, at one end, in a downward position, a circular extraction outlet 6 which has sealing closure means 7 constituted by a sort of frustum-shaped plug which is coupled, in a downward position, to a vertical stem 8 which is threaded upward for vertical actuation by means of the handwheel 9 which is arranged outside the chamber 1 and is screwed to the top of the stem.

Externally, the outlet 6 has a shaped lip 10 on which the mouth of a sludge collection bag 11 can be fixed, so as to form a seal, for example by means of a cord; said bag can also be of the disposable type, made of a material such as plastics.

The ceiling of the chamber 1 is provided with an inlet 12 and an outlet 13 for the sludge drying air (the flow of the air is schematically indicated by arrows in FIG. 1) which are connected to an airflow circuit with condenser 14 for condensation of the solvent from the air stream which avoids introducing into the dry-cleaning machine the unpleasant odors present in said sludge.

The reference numeral 15 indicates the separator of the dry-cleaning machine, to which the distilled solvent is conveyed from the condenser 14.

Inlets can be provided in the ceiling of the chamber, and a microwave source can be connected thereto if this system is to be used to dry the sludge instead of the drying circuit 14.

In this case the microwave source must be driven by sensors which detect the temperature inside the chamber to prevent an excessive temperature from leading to the degradation of the solvent.

Spatula-like means 16 are fixed on the shaft 4 and are constituted by a plurality of sectors 17 (five in the example illustrated in the figures) which extend radially and are inclined and distributed with a constant pitch along the shaft so as to define a sort of interrupted scroll.

The ends of the sectors 17 are provided with curved brush-like portions 18 which are suitable for scraping the bottom 3 of the chamber 12. Upon rotation of the shaft 4, the means 16 are suitable for stirring the sludge and for pushing it toward the outlet 6.

The sectors define an interrupted scroll to decrease the effort for removing the dense layer which occurs at the beginning of the distillation step and to allow the reflow of the undried sludge during distillation.

The operation of the distillation chamber according to the invention is evident: the rotation of the shaft 4 during the distillation steps causes, by virtue of the spatulas 16 fitted with brushes 18, the stirring of the sludge and the removal thereof from the bottom, accelerating the extraction of the solvent and preventing the reaching of the degradation temperature of said solvent.

As the sludge dries, it is conveyed toward the extraction outlet 6.

At the end of the drying step, the plug 7 is opened (by operating the handwheel 9) after fixing the mouth of the collection bag 11 on the shaped lip 10: by continuing to rotate the shaft 4, the brushes push the dried sludge into the bag.

It is then possible to close the mouth of the bag, as in FIG. 3, and close the plug 7; the dried sludge will be removed from the chamber without the operator or the environment making contact therewith.

It has thus been observed that the invention achieves the intended aim and objects.

The invention thus conceived is susceptible to numerous modifications and variations, all of which are within the scope of the inventive concept. All the details may furthermore be replaced with other technically equivalent ones.

In practice, the materials employed, as well as the shapes and dimensions, can be any according to the requirements, without thereby departing from the scope of the protection of the following claims.

We claim:

1. A distillation apparatus for removing dry-cleaning solvents from sludge, comprising:

distillation chamber for containing the sludge, said distillation chamber comprising an upper portion and a lower portion, said lower portion having a semi-cylindrical shape with a horizontally arrangeable axis;

means for heating the sludge inside said distillation chamber to evaporate solvents from the sludge;

means for condensing and separating evaporated solvents;

a rotatable shaft which is arranged inside said distillation chamber and parallel to said horizontally arrangeable axis;

a plurality of sector elements which are rigidly connected to said rotatable shaft and which are provided with curved brush-like end portions, said curved brush-like end portions being arranged so as to scrape said lower portion of said distillation chamber upon rotation of said rotatable shaft, said sector elements being arranged in an inclined and mutually spaced manner on said rotatable shaft so as to push sludge inside said distillation chamber toward an end thereof upon rotation of said rotatable shaft;

a sludge removing outlet provided at a bottom of said lower portion of said distillation chamber at said end thereof;

means for sealingly closing said sludge removing outlet; and a shaped lip connected to said sludge removing outlet and extending downwardly from said bottom of said lower portion; and a sludge collecting bag which is removably fixable in a sealed manner about said shaped lip.

2. A distillation apparatus according to claim 1, wherein said means for condensing and separating evaporated solvents comprise:

an air flow circuit with a condenser, said air flow circuit being connected between an air inlet and air outlet which are both arranged in communication with said distillation chamber at said upper portion thereof; and a separator which is connected to said condenser for collecting condensed solvents.

3. A distillation apparatus according to claim 1, wherein said sludge removing outlet has a circular shape and said means for sealingly closing said sludge removing outlet comprise:

a frustum shaped plug which is engageable in said sludge removing outlet;

a vertical shaft arranged inside said distillation chamber and having one end extending through said sludge removing outlet and rigidly connected to said plug and another end which is threaded and which extends through said upper portion of said distillation chamber; and a hand wheel which is screwed upon said other threaded end of said vertical shaft.

4. A distillation apparatus according to claim 1, wherein said rotatable shaft is driven by a motor-reduction unit assembly.

* * * * *